United States Patent [19]

Edelstein

[11] Patent Number: 4,664,177

[45] Date of Patent: May 12, 1987

[54] PUMPED TWO-PHASE HEAT TRANSFER LOOP

[75] Inventor: Fred Edelstein, Hauppauge, N.Y.

[73] Assignee: The United States of America as represented by the Administrator of the National Aeronautics and Space Administration, Washington, D.C.

[21] Appl. No.: 755,288

[22] Filed: Jul. 15, 1985

[51] Int. Cl.[4] ..... F28D 15/00

[52] U.S. Cl. ..... 165/1; 165/34; 165/104.26; 165/104.25; 165/104.14

[58] Field of Search ..... 165/104.25, 104.26, 165/34, 1; 126/422, 433

[56] References Cited

U.S. PATENT DOCUMENTS

| | | | |
|---|---|---|---|
| 3,994,279 | 11/1976 | Barab | 126/422 |
| 4,153,955 | 5/1979 | Hinterberger | 126/422 |
| 4,238,873 | 12/1980 | Frank et al. | 126/433 |
| 4,470,450 | 9/1984 | Bizzell et al. | 165/104.26 |

*Primary Examiner*—Albert W. Davis, Jr.
*Attorney, Agent, or Firm*—Hardie R. Barr; John R. Manning; Edward K. Fein

[57] ABSTRACT

A pumped loop two-phase heat transfer system, operating at a nearly constant temperature throughout, includes a plurality of independently operating grooved capillary heat exchanger plates supplied with working fluid through independent flow modulation valves connected to a liquid supply line, a vapor line for collecting vapor from the heat exchangers, a condenser between the vapor and the liquid lines, and a fluid circulating pump between the condenser and the heat exchangers.

6 Claims, 2 Drawing Figures

PUMPED TWO-PHASE HEAT TRANSFER LOOP

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

BACKGROUND OF THE INVENTION

The present invention relates to heat management systems, and more particularly to a high efficiency heat transfer system for transporting heat from a plurality of heat sources to one or more heat sinks. The invention, while described in some particulars with reference to spacecraft and space platform thermal management, will be seen to have perhaps even greater utility in terrestrial applications.

Heretofore, heat management and transfer systems have been predominantly passive circulation single phase (convective type), forced circulation single phase, forced circulation two phase, or passive circulation two phase. The forced circulation technologies typically involve considerable temperature gradients (and if phase change is involved there are also usually considerable pressure gradients). The "passive" circulation systems include, among others, the "absorption cycle" type and the heat pipe. Both of these two phase passive circulation technologies involve only small pressure gradients, and the heat pipe usually maintains a fairly constant temperature throughout. The advantages and disadvantages of the various technologies are well known, of course, to practitioners in the art.

For the past 20 years (starting with Gemini), the thermal management of manned spacecraft has relied on pumped (forced circulation) single phase liquid systems to collect, transport, and reject waste heat via a radiator. These systems have performed with excellent reliability. Evolving future space stations and platforms, however, will require a much more significant thermal management role because of multi-year mission durations, larger space station and platform sizes, the resulting longer physical distances involved in transporting the heat, larger quantities of waste heat to be dissipated, and the variety of payloads and missions which must be accommodated. Single phase pumped liquid systems become less and less attractive in such cases, due to such factors as weight, the energy needed to circulate sufficient liquid to accommodate the heat transfer loads, sometimes objectionable temperature differentials, limitations on system flexibility, and limited growth capability.

A review of such prior art patents as the following shows that they fail to teach or suggest a suitable solution to the above needs. For example, U.S. Pat. No. 2,448,261 (Gaugler, issued Aug. 31, 1948) discloses a type of heat pipe. However, as is well known, heat pipes of this type depend upon capillary action as the sole liquid transport mechanism. This places a limitation upon the overall capacity of the system to transport fluid, and thus to transport heat. Also, there is no active means for adjusting flow rates in response to local conditions.

U.S. Pat. No. 4,131,158 (Abhat et al., issued Dec. 26, 1978) shows a heating and heat storing system using a heat pipe therein. Again, the heat pipe is a passive circulation device, utilizing capillary action to circulate the operating liquid.

U.S. Pat. No. 4,177,858 (Daman et al., issued Dec. 11, 1979) discloses a heat exchanger using heat pipes to transfer heat between two separate fluid carrying chambers. Once again, the heat pipes are of the passive circulation/capillary action type.

U.S. Pat. No. 4,312,402 (Basiulis, issued Jan. 26, 1982) discloses an osmotically pumped heat transfer system employing a closed heat pipe together with solvent and solute-solvent mixture reservoirs separated from each other by a solvent permeable membrane.

U.S. Pat. No. 4,352,392 (Eastman, issued Oct. 5, 1982) shows a mechanically assisted method for supplying liquid to an evaporator surface, using a pump and a nozzle spray mechanism to improve distribution of the liquid over the evaporator surface. The pump is merely for providing the spray, and supplies a constant amount of liquid regardless of the needs or demands of the evaporator surface. It does not operate to improve circulation from a condenser to an evaporator and back. It does not pull/push vapor and liquid through a heat transfer circuit. Also, due to the need to disintegrate the fluid stream into a spray of small droplets, the pump pressure/energy parameters can be expected to be greater than with a lower pressure system which simply circulates the coolant.

U.S. Pat. No. 4,437,510 (Martorana, issued Mar. 20, 1984) discloses a heat pipe having an internal check valve located in the vapor channel of the heat pipe. The check valve, which is operated by very low pressure, allows vapor to flow only in a forward direction from a heat source to a heat sink. When the heat sink becomes hotter than the heat source, the valve blocks vapor flow in the reverse direction.

U.S. Pat. No. 4,467,861 (Kiseev at al., issued Aug. 28, 1984) shows a vapor jet pump heat transfer device described as using vapor pressure generated by the evaporation of a liquid working fluid to propel heated liquid working fluid through a heat exchanger where heat is lost to a heat sink. The liquid then returns back to a chamber from which capillary forces move the liquid working fluid into the evaporation area where heat from the heat source evaporates the liquid working fluid again. The vapor thus generated is described as operating a vapor jet pump, completing the cycle. The heat transfer is thus by heating and cooling of a liquid rather than by transfer to a heat sink by the working fluid vapor phase.

U.S. Pat. No. 4,467,862 (DeBeni, issued Aug. 28, 1984) discloses a passive heat transport system. An evaporator containing a liquid working fluid and in thermal communication with a heat source is connected by a tube to a condenser, itself in thermal communication with a heat sink. In a preferred embodiment the condenser contains a non-condensible gas. Heat from the source vaporizes the working fluid which, through gaseous expansion, is propelled to the condenser where it condenses to a liquid and compresses the non-condensible gas. Upon removal of the heat source (cooling the boiler), the compressed non-condensible gas expands, forcing the liquid working fluid back through the tube to the evaporator, completing the cycle. As understood, the device will also work when the boiler dries out even while still hot.

A need therefore remains for a light weight heat transfer system requiring minimal energy to circulate the necessary fluid to accommodate the system heat transfer loads; which need not operate with sometimes objectionable temperature differentials across the system; which offers maximum system flexibility and growth capability, high reliability, and low complexity. Such a system should also be inexpensive, durable, versatile, uncomplicated, reliable, inexpensive to manufacture, and readily suited to the widest possible utilization in terrestial as well as space applications.

SUMMARY OF THE INVENTION

Briefly, the present invention meets the above needs and purposes with a pumped, two phase, liquid-vapor phase change heat transfer system. The system, which works well with many common refrigerant fluids, includes a liquid line for the liquid phase of the fluid and a vapor line for the vapor phase. The system also includes a plurality of independent grooved capillary plate heat exchangers, each coupled to the liquid and to the vapor lines for imparting heat to the working fluid by receiving liquid from the liquid line, vaporizing the liquid, and delivering the vapor to the vapor line. Liquid working fluid spreads by capillary action upon the plates where it evaporates, cooling the plates.

A condenser receives vapor from the vapor line, condenses it to a liquid, and delivers the condensed liquid to the liquid line. A pump in series with the condenser propels the liquid from the condenser into the liquid line and draws vapor into the condenser from the vapor line.

In a preferred embodiment, the system also includes at least one additional heat exchanger connected to the vapor line for operating as a heat source by condensing vapor from the vapor line. A liquid suction line connects the side of each such additional heat exchanger opposite the vapor line to the side of the condenser which is connected to the liquid line.

Each heat exchanger, in a preferred embodiment, also has its own flow modulation valve for independently controlling the flow of working fluid into and out of the heat exchanger. In the preferred embodiment, the flow modulation valve operates in response to the heat load on its respective heat exchanger by admitting liquid or vapor to the heat exchanger in response to its temperature or liquid inventory in the heat exchanger.

As taught herein, the heat transfer system components preferably have capacities designed to maintain the working fluid in the system at a substantially constant temperature. In the preferred embodiment, this means that the temperature variation throughout the system is limited to substantially 5° C.

It is therefore an object of the present invention to provide an improved heat transfer system and method for transporting heat by liquid-vapor phase change of a working fluid; such a system and method having a liquid line for the liquid phase of such a working fluid and a vapor line for the working fluid vapor phase; which includes a plurality of heat exchangers each coupled to the liquid and the vapor lines for imparting heat to the working fluid by receiving liquid from the liquid line, vaporizing the liquid, and delivering the vapor to the vapor line; which also includes a condenser for receiving vapor from the vapor line, condensing the vapor to a liquid, and delivering the condensed liquid to the liquid line; which further includes a pump in series with the condenser for propelling liquid from the condenser into the liquid line and drawing vapor into the condenser from the vapor line; which also includes flow modulation valves for each of the heat exchangers for independently controlling the flow of working fluid into and out of each of the heat exchangers in response to the heat load thereon; which requires minimal energy to circulate the necessary fluid to accommodate the system heat transfer loads; which does not have to operate with sometimes objectionable temperature differentials across the system; which offers maximum system flexibility and growth capability, high reliability, and low complexity; and to accomplish the above objects and purposes in a light weight, inexpensive, durable, versatile, uncomplicated and reliable method and apparatus which are inexpensive to manufacture and readily suited to the widest possible utilization in terrestrial as well as space applications.

These and other objects and advantages of the invention will be apparent from the following description, the accompanying drawings, and the appended claims.

DESCRIPTION OF THE PREFERRED EMBODIMENTS

Figure 1:
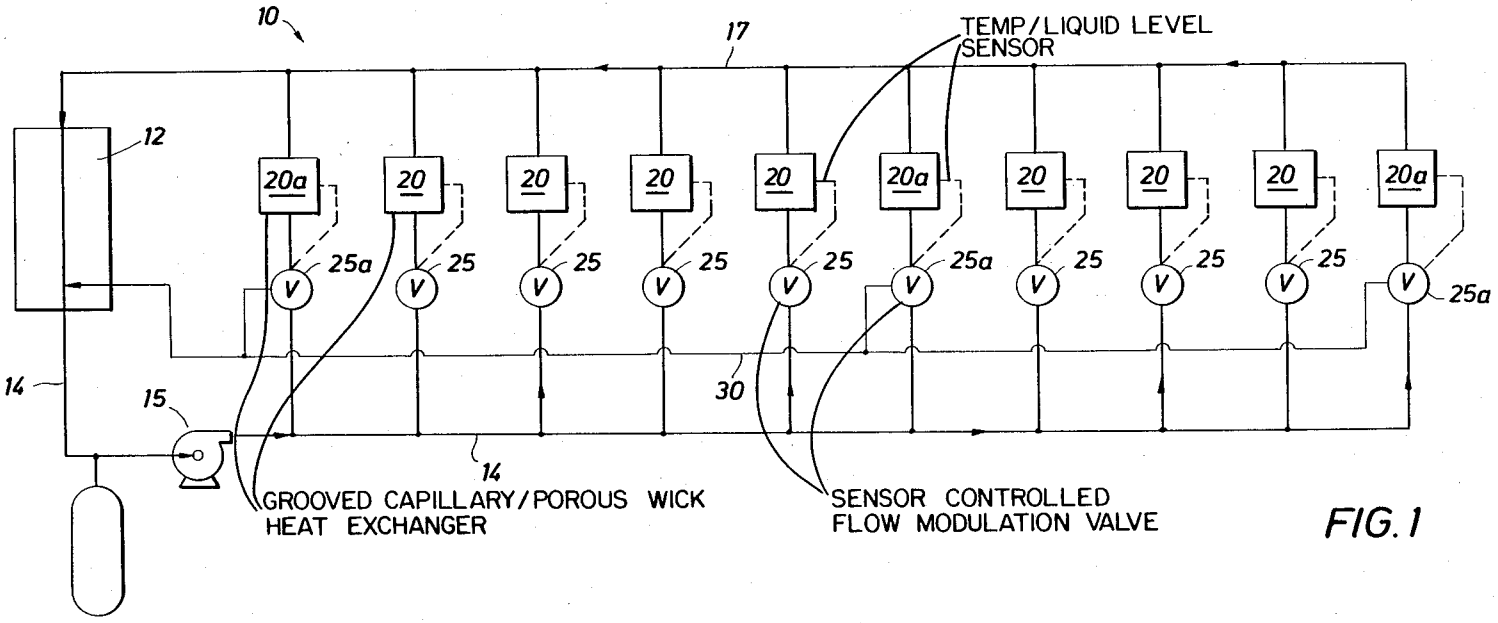
FIG. 1 is a schematic illustration of a heat transfer system according to the present invention.
Figure 2:
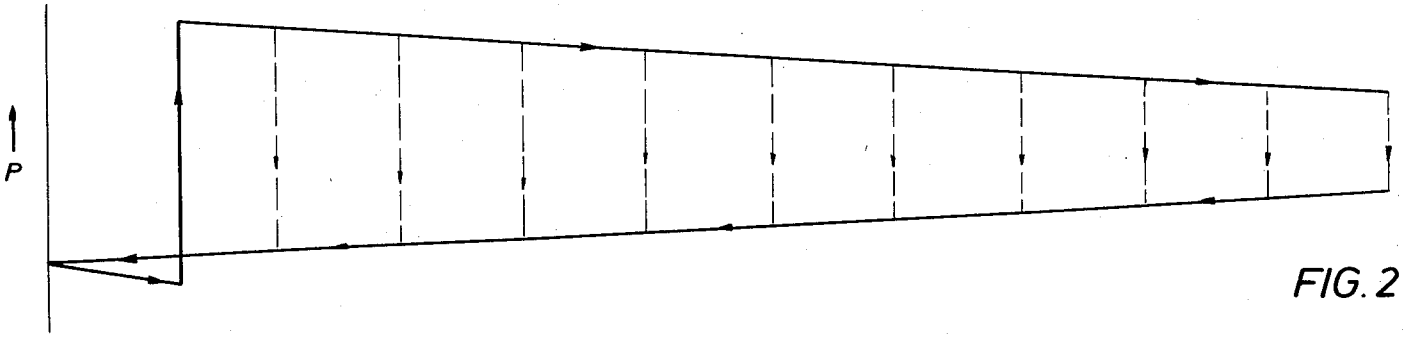
FIG. 2 is a generalized graphical illustration showing generally the pressure relationships of the working fluid in the system illustrated in FIG. 1.

With reference to the drawings, the new and improved heat transfer system for transporting heat by liquid-vapor phase change of a working fluid, and the method therefor according to the present invention, will be described. FIG. 1 shows the system 10 schematically. As may be seen therein, the working fluid (e.g., ammonia, Freon-11, Freon-114, etc.) first leaves a condenser 12, flowing as a subcooled liquid through a liquid line 14 to a central mechanical pump 15. Pump 15, located in line 14, raises the liquid line pressure above that of the vapor line 17 (see FIG. 2).

Between the liquid line 14 and the vapor line 17 is a plurality of grooved capillary plate heat exchangers 20. Exchangers 20, which operate independently of one another, each have a corresponding flow modulation valve 25 (FIG. 1). Valves 25 control the flow of liquid to each exchanger 20, independently controlling the flow of working fluid into and out of each heat exchanger 20 in response to the heat load thereon. In the preferred embodiment the valves 25 are temperature controlled valves, each connected to admit fluid in response to the temperature of the heat exchanger 20 with which it is associated. Alternatively, valves 25 may be of the type sensing the amount or inventory of liquid in the exchanger, each valve then operating to keep the amount of liquid in its respective exchanger substantially constant. Many such conventional valves, well known to practitioners in the art, will be found suitable for use with the present invention. (Temperature controlled valves, for example, include those actuated by a sealed system in which a sensing bulb contains a control fluid which operates against a diaphragm to actuate the valve. Inventory responsive valves, for example, include ultrasonic sensor valves which are electrically actuated by the output of an ultrasonic sensor which senses the presence of liquid within the grooved heat exchanger plate.)

At each heat exchanger plate 20, liquid is vaporized, the vapor flows to the vapor line 17, and from there the vapor is returned back to the condenser 12. In the preferred embodiment, liquid leaving the condenser will be subcooled, as mentioned above, prior to entering the pump 15. Although the pessure gradients throughout the system 10 are minimal, as discussed further below, there will be at least a nominal gradient in order to cause the fluids to circulate. Thus, the pump 15 will to some extent further increase the subcooling as it raises the liquid pressure. At the entrance to each plate, the subcooling will be essentially lost as the liquid pressure drops to near saturation across the various valves 25.

Heat exchanger plates 20 need to have only a modest capillary rise capability, such as that provided by grooved heat pipes, since only enough is needed to position the liquid within the plate. As a result, in addition to plates utilizing grooves, a relatively large diameter porous wicking may also be considered for transporting the liquid across the heat exchangers 20. Grooved plates (whether of the conventional or inverted meniscus design) are advantageous in terms of non-condensible gas, since gas bubbles could cause blockage in porous wicking but will vent easily in grooved plates.

Referring to FIG. 1, some of the heat exchangers have been numbered 20*a*. They are capable of operating as heat sources. That is, exchangers 20*a* can transfer heat to a payload from the heat transfer system 10, thus acting as heaters, rather than cooling the payload as with exchangers 20. Exchangers 20*a*, capable of acting thus as condensers by condensing vapor from the vapor line 17, include 3-way flow modulation valves 25*a* which are coupled to a liquid suction line 30. Line 30, which is connected to the side of each exchanger 20*a* opposite the vapor line 17, discharges the condensed liquid from exchangers 20*a* into the liquid line 14 which is itself connected to the condenser 12. By thus hydraulically connecting the liquid suction line 30 to the liquid discharge side of the condenser, provision is made for returning the condensate from exchangers 20*a* to the inlet to the pump 15. By this means, as the exchanger temperature drops, vapor will flow into the heat exchanger plates 20*a* from the vapor line 17, condense, and then flow back through line 30 to the inlet to the pump 15. The valves 25*a* may, of course, be controlled the same way as valves 25. Further, when a particular payload will require heat only, and not cooling, the connection for its associated heat exchanger to the liquid supply line 14 may, of course, be entirely omitted.

As may be seen, therefore, the present invention has numerous advantages. It provides a significant improvement over single-phase technologies in the thermal control of systems and equipment, especially those which benefit from relatively constant temperatures at all locations around the system loop. The entire loop, due to the vapor-liquid phase cycle, can be operated, for example, with temperature variations of 5° C. or less, which is about an order of magnitude less than the temperature differential of about 40° C. which is typical for a comparable single-phase loop in a similar situation. This means that equipment is less likely to fail due to temperature cycling. Also, equipment can be placed at any location on the loop since all locations operate at the same temperature.

Very little electrical power is required, especially in comparison with single-phase technologies. The lower power consumption results from smaller flow rates and more efficient operation due to the vaporization/condensation phase-change processes, which carry more heat per unit weight of fluid than processes which rely upon just the heat capacity of a fluid in only a single phase.

The high efficiency of the present invention is also in part a result of the operation at a nearly constant temperature throughout the system. This means that the pump merely causes the fluid to circulate. The pump does not have to force a working fluid to liquify (cf., gaseous compressor types), as in a typical refrigeration or air conditioning system. The present system does not expand energy creating a temperature differential, but rather simply transports heat more efficiently from source(s) to sink(s) which are already at a temperature differential.

Due to the temperature and pressure vapor-liquid phase equilibrium in the system, locations or equipment requiring heat input can make use of waste heat from other equipment without special additional plumbing and flow loops, and without having to use other sources such as electric heaters.

Another advantage provided by the present invention is that growth and expansion of the long can be more easily made by adding additional parallel branches. Thus, since the system is a parallel system, with each of the heat exchangers 20 and 20*a* operating substantially independently of the others, all the exchangers receive roughly equal treatment regardless of location. (This is due to the nearly equal pressure and temperature conditions which are maintained by the working fluid which is at its phase change equilibrium.)

Still another advantage is the savings in radiator and heat exchanger weight. This is because, due to the vaporization and condensation of the working fluid, the heat is transferred more efficiently (at a smaller temperature differential).

The invention has additional advantages, not only in comparison with single-phase systems and high pressure differential two-phase systems, but also when compared with heat transfer systems such as heat pipes. Thus, a major advantage of the present invention is that a supply of power-circulated liquid (propelled by pump 15) feeds the evaporator plates of the heat exchangers 20 through the valves 25, rather that relying upon a liquid which is sucked into evaporator plates by weaker capillary forces. The system is therefore less affected by geometric constraints, by orientation, by equipment location, and so forth. Also, separate liquid and vapor lines allow pipes to be tilted or run vertically without producing unusual flow patterns characteristic of two-phase flow in a single line. System performance predictability is thus enhanced when dealing with single-phase flow.

Because the heat exchanger plates do not need a strong wicking capability (only enough to distribute liquid over the heat transfer surface), plate design is simpler, tolerance to non-condensible gas is better, and weaker capillary fluids (such as Freons) can be more readily considered, especially if toxicity of other working fluids (e.g., ammonia) is a factor.

Finally, although flow to the heat exchangers 20 and 20*a* has been described as being modulated by suitable valves 25 and 25*a*, it will also be understood that other flow control means can be considered, as may be appropriate. Examples include variable speed and on/off pumps.

While the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. A heat transfer system for transporting heat by liquid-vapor phase change of a working fluid, comprising:

(a) a liquid line for the liquid phase of such working fluid, (b) a vapor line for the working fluid vapor phase, (c) a condenser for receiving vapor from said vapor line, condensing the vapor to a liquid, and delivering the condensed liquid to said liquid line, (d) at least one independent heat exchanger coupled to said liquid and said vapor lines and adapted for imparting heat to the working fluid by receiving liquid from said liquid line, vaporizing the liquid, and delivering the vapor to the vapor line.

(e) another independent heat exchanger connected to said vapor line operable as a heat source for condensing vapor from said vapor line, and further comprising a liquid suction line connecting the side of said condensing heat exchanger opposite said vapor line to the liquid side of said condenser, (f) pump means in series with said condenser for propelling liquid from said condenser into said liquid line and drawing vapor into said condenser from said vapor line, and (g) flow modulation means for each said heat exchanger for independently controlling the flow of working fluid into and out of said heat exchangers in response to the heat load thereon.

2. The heat transfer system of claim 1 wherein the heat exchanger adapted for imparting heat to the working fluid and the heat exchanger operable as a heat source may be one and the same heat exchanger.

3. A heat transfer system for transporting heat by liquid-vapor phase change of a working fluid, comprising:

(a) a liquid line for the liquid phase of such a working fluid, (b) a vapor line for the working fluid vapor phase, (c) a plurality of independent grooved capillary plate heat exchangers each coupled to said liquid and to said vapor lines for imparting heat to the working fluid by receiving liquid from said liquid line, vaporizing the liquid, and delivering the vapor to the vapor line, (d) a condenser for receiving vapor from said vapor line, condensing the vapor to a liquid, and delivering the condensed liquid to said liquid line, (e) pump means in series with said condenser for propelling liquid from said condenser into said liquid line and drawing vapor into said condenser from said vapor line.

(f) at least one additional heat exchanger connected to said vapor line for operating as a heat source by condensing vapor from said vapor line, (g) a liquid suction line connecting the side of said additional heat exchanger opposite said vapor line to the liquid side of said condenser.

(h) a temperature controlled flow modulation valve for each said heat exchanger for independently controlling the flow of working fluid into and out of each said heat exchanger, in response to the heat load thereon, by admitting fluid to the corresponding said heat exchanger in response to the temperature thereof, and (i) the components of said heat transfer system having predetermined capacities for maintaining the working fluid therein at a substantially constant temperature by limiting the variation thereof throughout the system to substantially 5° C.

4. A method for transporting heat by liquid-vapor phase change of a working fluid, comprising:

(a) imparting heat to such a working fluid by receiving liquid working fluid from a liquid line into at least one independent heat exchanger, vaporizing the liquid in the heat exchanger, and delivering the vapor to a vapor line, (b) with the aid of a pump in series with a condenser, drawing vapor into the condenser from the vapor line, condensing the vapor within the condenser to a liquid, and propelling the condensed liquid from the condenser into the liquid line, (c) supplying vapor from the vapor line to another independent heat exchanger adapted for operation as a heat source by condensing vapor from the vapor line, and removing condensed liquid from such a heat exchanger into a liquid suction line which is in turn connected to the liquid side of the condenser, and (d) independently controlling the flow of working fluid into and out of each of said heat exchangers in response to the heat load thereon.

5. The method for transporting heat of claim 4, further comprising:

operating one and the same heat exchanger in a first mode to impart heat to the working fluid and in a second mode as a heat source.

6. A method for transporting heat by liquid-vapor phase change of a working fluid, comprising:

(a) imparting heat to such a working fluid by receiving liquid working fluid from a liquid line into a plurality of independent grooved capillary plate heat exchangers, vaporizing the liquid in the heat exchangers, and delivering the vapor to a vapor line, (b) with the aid of a pump in series with a condenser, drawing vapor into the condenser from the vapor line, condensing the vapor within the condenser to a liquid, and propelling the condensed liquid from the condenser into the liquid line, (c) supplying vapor from the vapor line to at least one additional heat exchanger for operating it as a heat source by condensing vapor from the vapor line, (d) removing condensed liquid from the additional heat exchanger into a liquid suction line which is in turn connected to the liquid side of the condenser, (e) independently controlling the flow of working fluid into and out of each heat exchanger in response to the heat load thereon, by admitting fluid to the corresponding responding heat exchanger in response to the temperature thereof, and (f) maintaining the working fluid at a substantially constant temperature throughout by limiting the variation thereof to substantially 5° C.

* * * * *